US007223252B2

(12) United States Patent
Takahashi

(10) Patent No.: US 7,223,252 B2
(45) Date of Patent: May 29, 2007

(54) FINGER-PRESSURE SUBSTITUTIVE STIMULATOR

(76) Inventor: Hiroyoshi Takahashi, c/o Nihon Creation Co., Ltd., 180 Katsuzawa-cho, Maebashi, Gumma 371-0124 (JP)

( * ) Notice: Subject to any disclaimer, the term of this patent is extended or adjusted under 35 U.S.C. 154(b) by 145 days.

(21) Appl. No.: 10/889,172

(22) Filed: Jul. 13, 2004

(65) Prior Publication Data

US 2004/0254510 A1 Dec. 16, 2004

Related U.S. Application Data

(63) Continuation of application No. 09/913,958, filed as application No. PCT/JP99/07356 on Dec. 27, 1999, now abandoned.

(51) Int. Cl.
*A61H 39/04* (2006.01)

(52) U.S. Cl. ..... 601/134; 601/136; 606/204

(58) Field of Classification Search ..... 601/134–137; 428/134; 606/204
See application file for complete search history.

(56) References Cited

U.S. PATENT DOCUMENTS

| | | | | |
|---|---|---|---|---|
| 1,006,630 | A * | 10/1911 | Clarke | 15/188 |
| 1,618,165 | A * | 2/1927 | Boschelli | 4/583 |
| 3,616,154 | A * | 10/1971 | Dow et al. | 428/134 |
| 4,133,481 | A * | 1/1979 | Bennett | 238/14 |
| 5,080,090 | A * | 1/1992 | Liau et al. | 601/134 |
| 5,236,241 | A * | 8/1993 | Courrege | 296/97.23 |
| 5,455,100 | A * | 10/1995 | White | 428/131 |
| 5,993,936 | A * | 11/1999 | Gardner | 428/131 |

FOREIGN PATENT DOCUMENTS

| | | | |
|---|---|---|---|
| EP | 0 630 638 | | 12/1994 |
| EP | 0 779 068 | | 6/1997 |
| EP | 1 161 931 | A1 | 12/2001 |
| EP | 1 161 931 | B1 | 12/2003 |
| JP | 52 160 288 | | 12/1977 |
| JP | 58-28589 | | 6/1983 |
| JP | 10-32868 | | 12/1998 |
| JP | 10-314269 | | 12/1998 |
| JP | 10328268 | A * | 12/1998 |

* cited by examiner

*Primary Examiner*—Danton DeMille
(74) *Attorney, Agent, or Firm*—Rabin & Berdo, P.C.

(57) ABSTRACT

A finger-pressure substitutive stimulator comprises a supple, net-like sheet member having many stripe-like projections on one surface thereof and formed of various hard or semi-hard synthetic resin materials. The finger-pressure substitutive stimulator is fixed to the surface of the skin of a human body at a part to be treated using an appropriate fixing means—e.g., commercially available adhesive tapes, bandages, and supporters—or an adhesive sheet fastened to the smooth rear surface of the sheet member; it serves to ease or remove pain by correcting such ailments as rheumatism, neuralgia, shoulder stiffness, lumbago, and visceral disorders. The stripe-like projections pressed against the skin surface provide uniform, sustained stimulation to the peripheral nerves in the human body surface layer over the entire wide region to which the stimulator is attached and effectively correct disorders and abnormalities of the human body, thereby removing or easing pains. Due to the net-like structure and suppleness of the sheet member, one or a small number of stimulators can provide effective and sufficient stimulation to a wider region than conventional stimulators while easily conforming to a curved shape of a part to be treated and ensuring air permeability to the skin surface.

4 Claims, 11 Drawing Sheets

FINGER-PRESSURE SUBSTITUTIVE STIMULATOR

CROSS REFERENCE TO RELATED APPLICATION

This application is a Continuation Application of application Ser. No. 09/913,958 of Jan. 29, 2002 , now abandoned which is a national phase application of International Application PCT/JP99/07356, International filing date Dec. 27, 1999.

FIELD OF THE INVENTION

The present invention relates in general to a finger-pressure substitutive stimulator. More particularly, the present invention relates to a finger-pressure substitutive stimulator that is applied to a region where pain spots exist continuously in the human body surface layer and provides stimulation to that region so as promote blood circulation, thereby easing or removing the attendant pain.

BACKGROUND OF THE INVENTION

When such disorders as rheumatism, neuralgia, shoulder stiffness, and lumbago occur in the human body, the reaction appears mainly as pain in regions related to the human body surface layer. In some cases this pain is felt directly and in others it is felt indirectly, such as when pressed. The part where this pain is felt is generally called a pain spot. It is well known that the pain can be eased or removed by using finger-pressure therapy, i.e., stimulating the pain spot by pressing with a finger or fingers. As a device for applying stimulation similar to that of finger-pressure therapy to the skin and thereby providing a therapeutic effect for rheumatism, neuralgia, shoulder stiffness, lumbago, etc., there is a conventional stimulator that comprises a stimulating piece—shaped like a short cylinder with both ends rounded—attached to the center of the bonding surface of a circular base-fabric sheet and is used by attaching the stimulator such that the protruding end parts of the stimulating piece are pressed against the skin of the user. However, the therapeutic effect of this stimulator is low because there is little stimulation of the skin; this stimulator is also disadvantageous in that the stimulating piece peels easily from the base-fabric sheet.

In Japanese Utility Model Publication 58-28589, the present inventor proposed a finger-pressure substitutive stimulator that resolves these disadvantages and provides a high therapeutic effect. This stimulator comprises a thin circular stimulating piece that is normally formed of a hard synthetic resin material and attached to the center of a circular base-fabric sheet coated with a pressure sensitive adhesive; three ridges that extend radially from the center are formed on the surface of the stimulating piece. When this stimulator is used by attaching it in such a manner that said ridges are pressed against the skin, the pain spots are constantly stimulated by the ridges and, consequently, the cutaneous sensory nerves and free nerve endings at the skin surface are stimulated. As a result, blood circulation is improved and such ailments as rheumatism, neuralgia, shoulder stiffness, lumbago, and visceral disorders are corrected, thereby easing or removing the pain at related locations.

Explaining in more detail, when an abnormality occurs in the internal or external environment of a living body, a localized reaction appears in a certain range of the skin surface corresponding to the abnormal part. The size of the range depends on the symptoms and the extent of the abnormality, and the reaction location typically has several hypersensitive spots (called "pain spots"), each approximately 3 to 5 mm in size, interspersed therein. When a finger-pressure substitutive stimulator like that described in the aforementioned publication is attached to the pain spot while the skin surface is tensioned thoroughly, the ridges on the surface of the stimulator apply an appropriate degree of stimulation to the free nerve endings in the skin surface layer. This sustained stimulation is reflexively transmitted from the free nerve endings to the related internal environment of the body in an afferent manner. That is, the stimulation is received by the free nerve endings and transmitted to the center of the innervation region thereof. Likewise, the abnormal part of the reacting body is reflexively stimulated and corrected and, thus, healed. In this way, the stimulation applied by said finger-pressure substitutive stimulator against the feeling of pain that appears as a pressure-pain spot in the skin surface layer when localized nerves are excited by a circulation obstruction of blood flow, a bodily fluid, etc., is thought to perform an interceding role that communicates the healing of the localized part where the obstruction is occurring to the nerve center of said part.

However, it is not uncommon for pain points in the human body surface layer caused by such abnormalities as rheumatism, neuralgia, shoulder stiffness, and lumbago to appear densely over a relatively wide range the skin surface. In such a case, with a finger-pressure substitutive stimulator like that described in the aforementioned publication, it is necessary to stick many, e.g., several ten to several hundred, to the skin surface at narrow intervals. Consequently, there are the problems that a very considerable amount of labor is required and the process is time consuming.

In view of these problems, the present inventor conceived a stimulator comprising a large number of said stimulating pieces fastened in a row at roughly fixed intervals to an adhesive sheet shaped like tape with a fixed width, thus making it possible to attach many stimulating pieces to the skin surface at once. With this stimulator, a large number of stimulating pieces can be arranged at relatively uniform intervals on a wide surface area of skin by attaching a plurality of adhesive sheets such that they are parallel and the side edges of adjacent adhesive sheets partially overlap each other and, preferably—in order to increase the therapeutic effect—such that the stimulating pieces of adjacent adhesive sheets are positioned alternately in the lengthwise direction. However, since the adhesive sheets have side edge portions that overlap each other, the interval between stimulating pieces on adjacent adhesive sheets is larger than the interval between stimulating pieces on the same adhesive sheet and it is difficult to obtain a well-balanced arrangement of stimulating pieces. Meanwhile, if the width of the adhesive sheets is narrowed in order to reduce the overlapping side edge portions of adjacent adhesive sheets, a problem will occur in that the adhesive strength with respect to the skin surface will decline such that the adhesive sheet will peel easily or the strength of the force pressing the stimulating pieces against the skin will weaken, resulting in a decrease of the therapeutic effect.

Therefore, as presented in Laid-Open Japanese Patent Publication No. 10-314269, the present inventor proposed a finger-pressure substitutive stimulator in which the outline part of the adhesive sheet—on which a plurality of thin stimulating parts having projections on the surface thereof are attached at roughly uniform intervals—is provided with narrow portions that are recessed toward the middle portion between each respective stimulating piece adjacent to said outline part. Since a succeeding adhesive sheet can be attached such that its stimulating pieces partially fit inside the narrow parts of a previously attached adhesive sheet, this improved stimulator makes it possible to achieve a well-balanced arrangement in which the intervals between the respective stimulating pieces of a plurality of adhesive sheets is smaller and overall more uniform, thus improving the therapeutic effect. Furthermore, peeling from the skin surface and decline of the force pressing against the skin can be prevented because the adhesive sheet secures sufficiently large adhesion surface area at the periphery of each stimulating piece and obtains sufficient adhesive strength with respect to the skin surface.

In Laid-Open Japanese Patent Publication No. 10-314269, the present inventor also proposed a finger-pressure substitutive stimulator in which a plurality of adjacent stimulating pieces are attached to a tape-shaped adhesive sheet are made continuous with one another by flexible or bendable connecting pieces that are belt-shaped, rope-shaped, or thread-shaped. Due to the flexibility or bendability of the connecting pieces, this stimulator can be attached so as to conform well to curved portions of the skin surface.

However, in order to attach them to a wider area of the skin surface, conventional finger-pressure substitutive stimulators—even the improved stimulators described in the aforementioned patent application—require the use of a large number of stimulators and thus require spending much labor and time. Also, when used on curved parts of the skin—particularly the joints of the hands and feed and the fingers—it is difficult to attach conventional stimulators such that the stimulating pieces conform to the curved shape and provide well-balanced, sufficient therapeutic effect; also, some degree of skill is required. Moreover, when the part where the stimulator is attached curves or bends due to exercise of the human body and its curved shape changes, there is the risk that the stimulator cannot accommodate the change and cannot apply a roughly constant stimulation to the skin surface at all times.

Therefore, the object of the present invention is to resolve the problems of the prior art and provide a finger-pressure substitutive stimulator that is relatively easy to apply to the skin surface and also can accommodate even when the treatment part of the skin surface has a wide area or is curved or the surface shape of said part changes during exercise, thus applying a roughly constant stimulation to the skin at all times.

PRESENTATION OF THE INVENTION

In order to solve the aforementioned conventional problems, the finger-pressure substitutive stimulator of the present invention is characterized by comprising a supple sheet member formed so as to be net-like and having many stripe-like projections formed evenly on one surface of said sheet member.

This finger-pressure substitutive stimulator can be fixed to the treatment part of the skin surface using an appropriate fixing means, e.g., commercially available adhesive tapes, bandages, and supporters. Since air permeability is ensured by the meshes of the sheet member, there is no risk oHf the skin surface becoming warm and damp and developing itchiness, a rash, or other inflammation.

In one embodiment, by fastening the other surface of the sheet member, i.e., the smooth rear surface on which said stripe-like projections are not formed, to the bonding surface of an adhesive sheet that is coated with an adhesive the finger-pressure substitutive stimulator can be attached as is to the skin and easily fixed without using the aforementioned separate fixing means. The adhesion can be improved by making the meshes of the sheet member large because the bonding surface of the adhesive sheet will stick to the surface of the skin through the meshes.

When the stimulator of the present invention is used by fixing it to the skin as described above and pressing surface of the sheet member on which the stripe-like projections are formed against the treatment part of the skin, even if the part is curved the sheet member is net-like and supple and can therefore: conform well to the curved shape of said part, cause the many projections to act roughly evenly at all times against the skin, and continue applying the required stimulation. Therefore, the desired sufficient therapeutic effect can be obtained with respect to a wider area than with conventional stimulators.

Moreover, when the part where the net-like, supple sheet member is attached curves or bends due to exercise of the human body and its curved shape changes, the sheet member can conform to the change relatively easily and can continue to apply a roughly constant stimulation to the skin surface. In the case of a finger or other slender, round part, a large number of projections can be made to operate effectively in a similar manner by wrapping said sheet member around the part.

Also, with the finger-pressure substitutive stimulator of the present invention, the size of the sheet member can be appropriately selected according to the need and a large area of skin surface can be covered with one or a small number of stimulators. As a result, the time and labor associated with attaching the stimulator can be greatly reduced compared to the prior art and treatment can be conducted extremely efficiently and quickly.

In one embodiment, said finger-pressure substitutive stimulator can be manufactured easily by integral molding using various hard or semi-hard synthetic resin materials. This stimulator is beneficial because the suppleness—and in some cases the elasticity—of the material itself improves the conformability with respect to the skin surface when the sheet member is attached to a part where the skin is curved and/or when the human body exercises. Also, when the part to be treated is smaller than the size of the sheet member, the stimulator can be easily cut to match the size of said part.

BEST MODES FOR WORKING THE INVENTION

Below, the present invention is described in detail using the preferred embodiments thereof while referring to the attached drawings.

Figure 1:
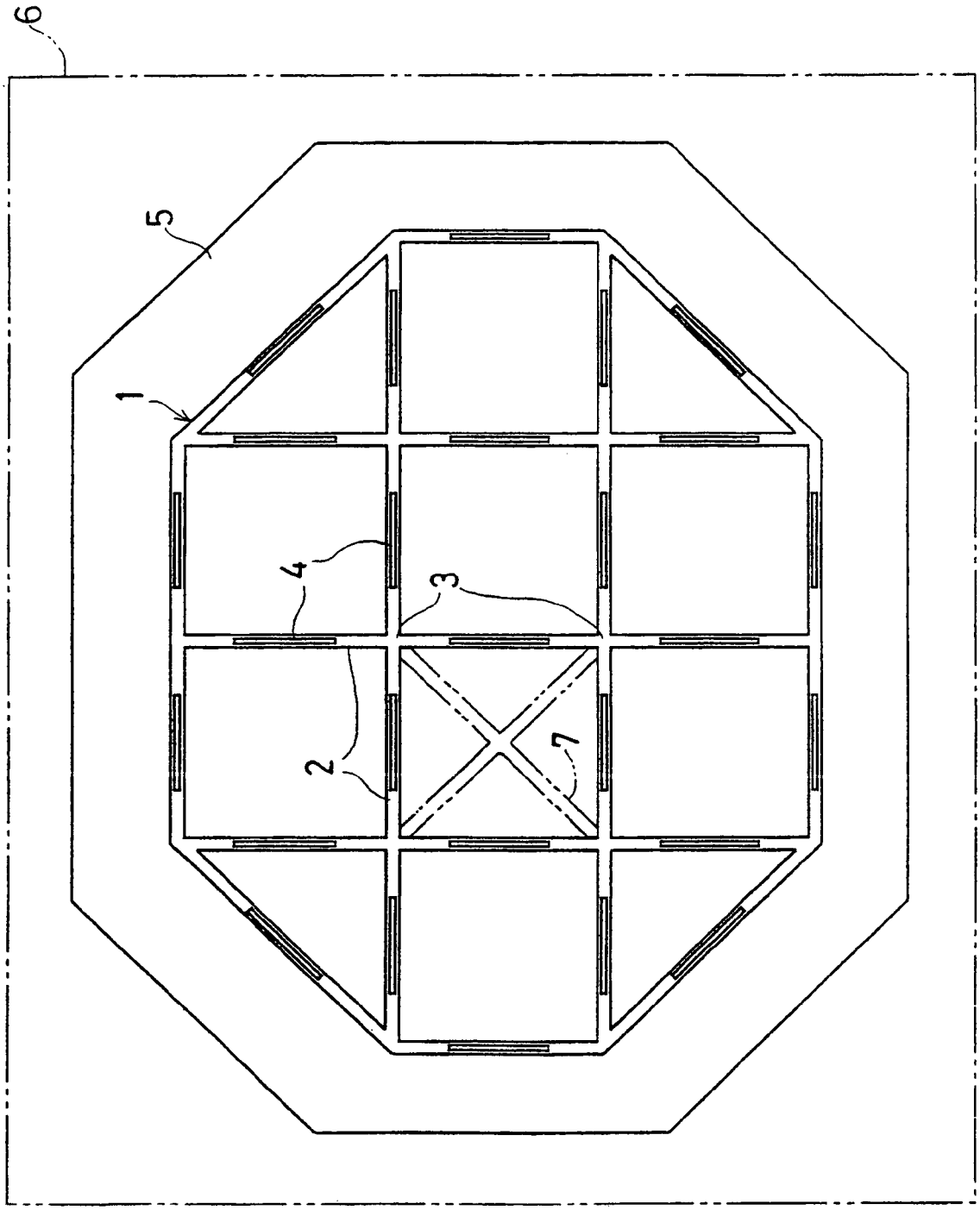
FIG. 1 is a plan view showing a first embodiment of a finger-pressure substitutive stimulator in accordance with the present invention.
Figure 2A:
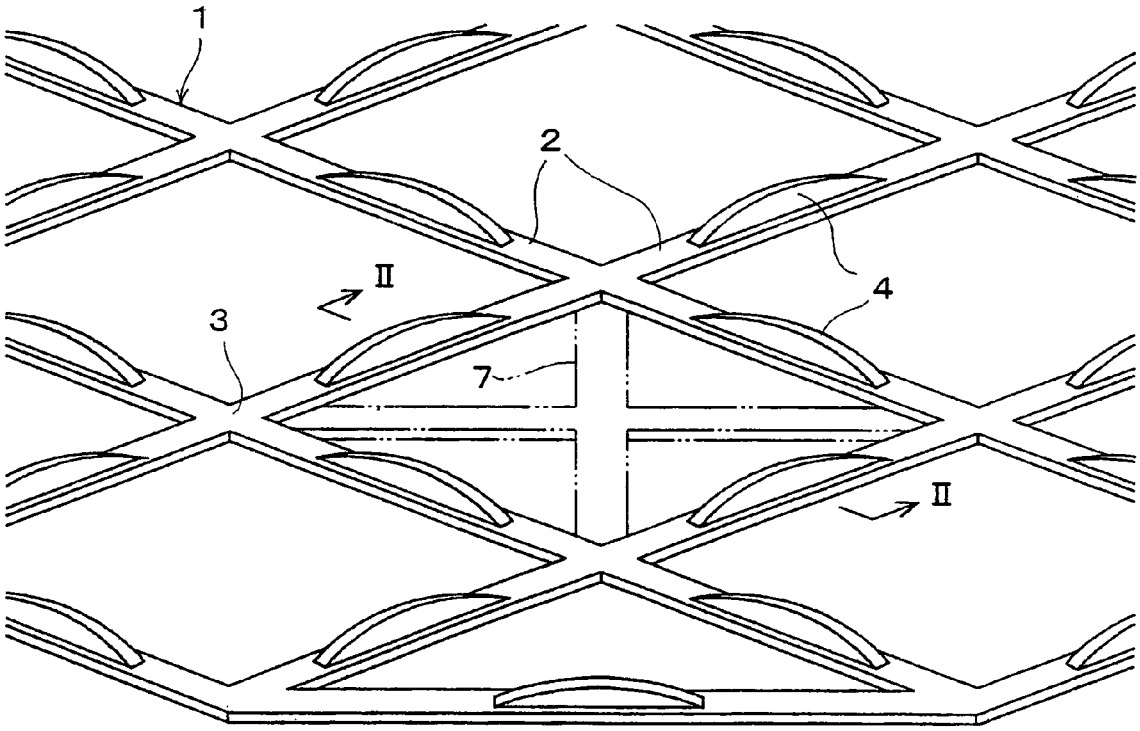
FIG. 2A is an enlarged perspective view of the first embodiment and FIG. 2B is a cross sectional view taken along line II-II.
Figure 2B:
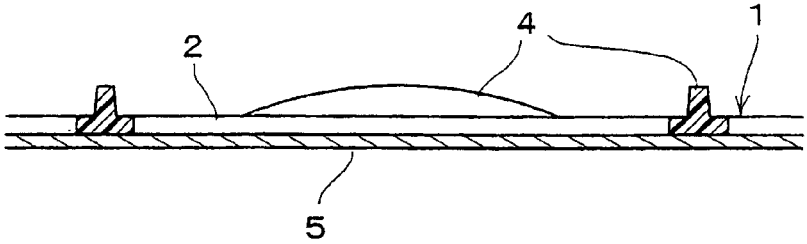

FIG. 1 and FIG. 2 show a first embodiment of a finger-pressure substitutive stimulator in accordance with the present invention. As shown in FIG. 1, the stimulator of the first embodiment comprises thin, net-like sheet member 1 whose outline forms an octagonal shape obtained by diagonally and linearly cutting off the corners of a rectangle. Sheet member 1 is formed into a net-like form having slender, linear cord parts 2 that extend parallel to the respective horizontal and vertical sides of the sheet member and knot parts 3 that serve as joints of the net. As also shown in FIG. 2, many projections 4 are provided integrally and evenly over roughly the entire surface of the sheet member.

As shown well in FIGS. 2A and B, these projections 4 have a slender, straight stripe-shape that has a relatively low height and a gentle arc shape with a large curvature when viewed from the side and a cross section that is tapered slightly in the upward direction. Stripe-like projections 4 are disposed in roughly the center of each cord part 4 of sheet member 1 at fixed intervals from each other. Various shapes other than an arc shape can be used for the shape of the projections.

The smooth rear surface of sheet member 1 is fastened to the adhesive surface—which is coated completely with a pressure sensitive adhesive—of an adhesive sheet 5 that has somewhat larger dimensions than and roughly the same shape as the sheet member. Adhesive sheet 5 is formed from various well-known materials, such as the soft synthetic resins and fabric used in commercially available adhesive bandages and adhesive tapes. In order to protect its adhesive surface and prevent degradation of the adhesion, adhesive sheet 5 normally has attached thereto a release paper 6 that has dimensions at least larger than those of the adhesive sheet and has been surface-treated with silicon or the like.

Sheet member 1 can be formed integrally with projections 4 by using well-known molding methods with a variety of previously known hard and semi-hard synthetic resins so that when the sheet member is pressed against the skin surface of a human body, it will have the suppleness to conform to the curved shape of the body. Naturally, in another embodiment, the sheet member and projections can be formed using a material other than synthetic resin. In still another embodiment, the sheet member and the projections can be molded using separate materials, respectively, and then joined to make an integral unit. In either case, it is preferred that sheet member 1 be thin so that it will have sufficient suppleness.

In still another embodiment, reinforcing cord parts 7 that extend along the diagonals of the square meshes can be provided as indicated by the imaginary lines in FIG. 1 and FIG. 2A in order to reinforce sheet member 1.

When the finger-pressure substitutive stimulator of the present embodiment is used, the part where there is pain or stiffness resulting from rheumatism, neuralgia, shoulder stiffness, lumbago, etc., is pressed with a finger to check the pain spots related to said pain, etc. Next, after removing release paper 6, said stimulator is attached to the region of the skin surface where the pain spots are interspersed in such a manner that projections 4 are pressed there-against. When the treatment part is a finger, the neck, or other slender part, sheet member 1 has sufficient suppleness and should therefore be attached so as to wrap there-around. Thus, sustained stimulation can be applied to the nerve endings in the human body surface layer evenly over the entirety of said region; as previously discussed in relation to the prior art, parts of the human body having disorders and abnormalities can be corrected effectively and the pain, etc., can be eased or removed.

In this embodiment, the thickness of sheet member 1 is 0.3 mm and projections 4 of length 5 mm, height 1 mm, and width 0.3 mm are formed on linear cord parts 2 that are of width 1 mm and arranged at 10-mm intervals. The inventor's long years of research and clinical study has confirmed that even if the size of projections 4 is slight, sufficient stimulation to achieve sufficient therapeutic effect can be applied.

Also, since the meshes of sheet member 1 are relatively large, the adhesive surface of adhesive sheet 5 will stick to the skin through the meshes and the stimulator can be more securely fixed to the skin, thus facilitating the therapeutic effect. Also, since sheet 1 is net-like, even though the sheet member is fixed to the skin using adhesive sheet 5, gaps are secured between the skin surface and the sheet member at the net portion and warm dampness caused by perspiration and attendant itchiness, rashes, etc., are alleviated.

The sheet member, the dimensions and shape of its mesh, and the dimensions and arrangement of the projections can be selected as appropriate to differ from what has been previously described. However, the sheet member can be cut to the appropriate size and shape using scissors or a box cutter when the sheet member is too large for the part to be treated or when the region contains a portion where it is undesirable to apply stimulation.

FIGS. 3 to 6 each show a finger-pressure substitutive stimulator in which the shape, dimensions, and arrangement of the projections of the first embodiment have been modified. In the modification example shown in FIGS. 3A and B, roughly the entire length of each cord of the net is formed with a stripe-like projection 4 that has a longer arc shape than in the embodiments shown in FIGS. 1 and 2 and the cords are joined at both ends at the knot part. In the modification example shown in FIGS. 4A and B, arc-shaped stripe-like projections 4 are arranged so as to span across each respective knot part and be directly joined together at both ends at the center of the cord parts, thus forming cross-shaped projections having their centers at the knot parts. In this case, the projections can also be formed with short lengths such that both ends are not directly joined at the center of the cord parts.

Figure 3A:
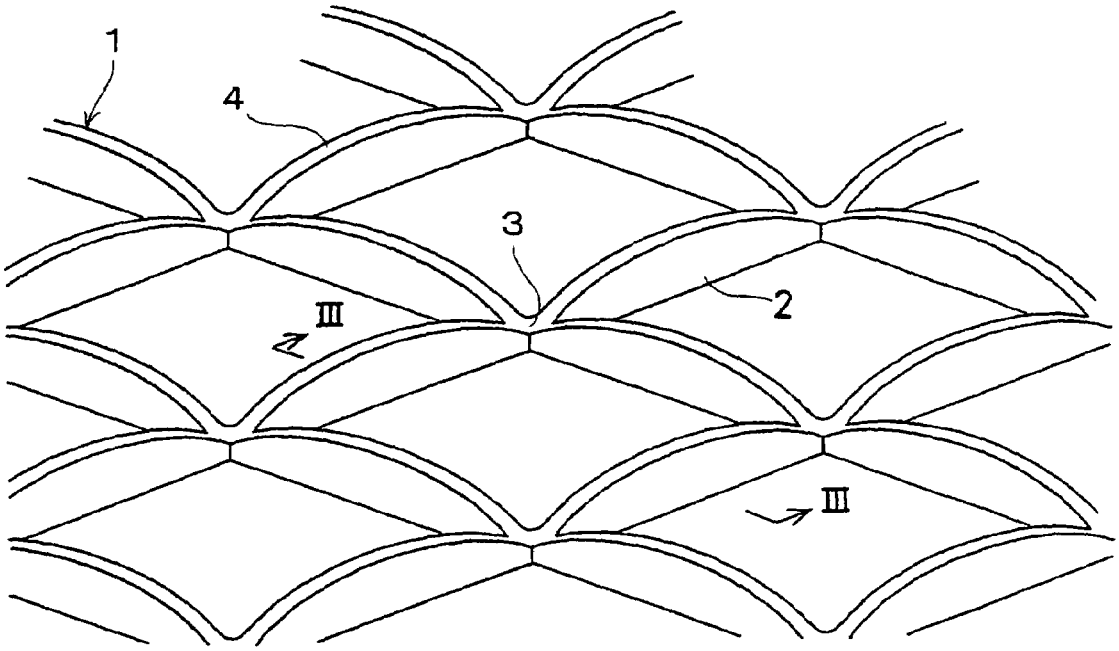
FIG. 3A is an enlarged perspective view showing a modification of the first embodiment and FIG. 3B is a cross sectional view taken along line III-III.
Figure 3B:
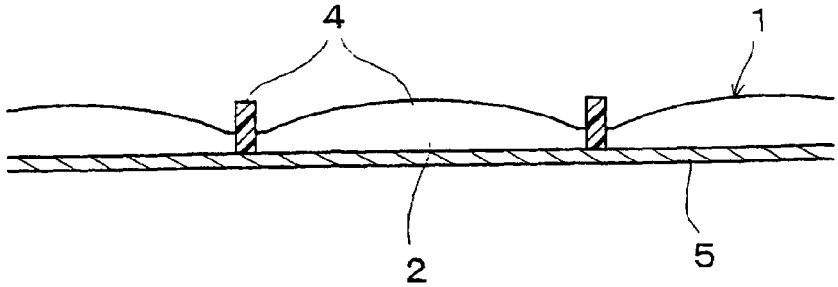
Figure 4A:
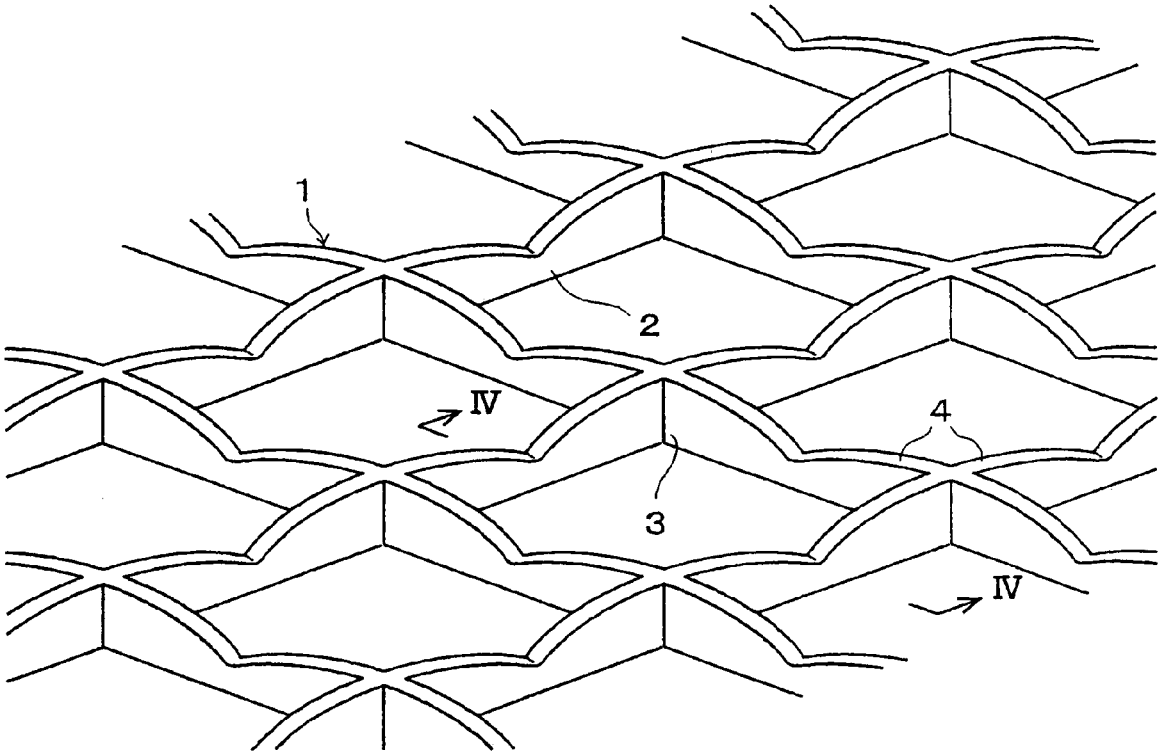
FIG. 4A is an enlarged perspective view showing another modification of the first embodiment and FIG. 4B is a cross sectional view taken along line IV-IV.
Figure 4B:
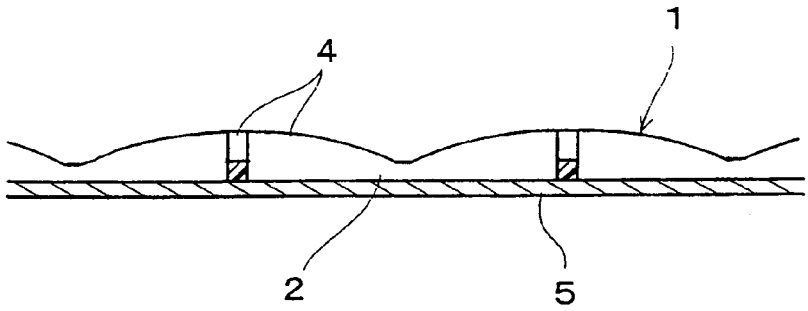
Figure 5A:
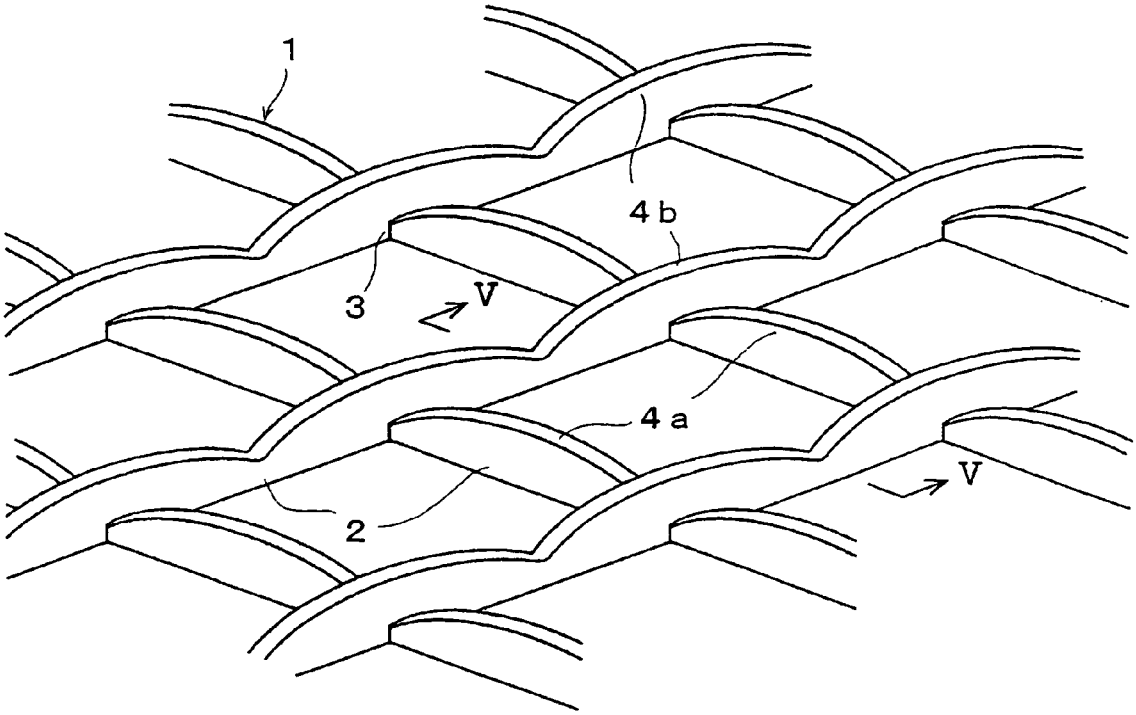
FIG. 5A is an enlarged perspective view showing another modification of the first embodiment and FIG. 5B is a cross sectional view taken along line V-V.
Figure 5B:
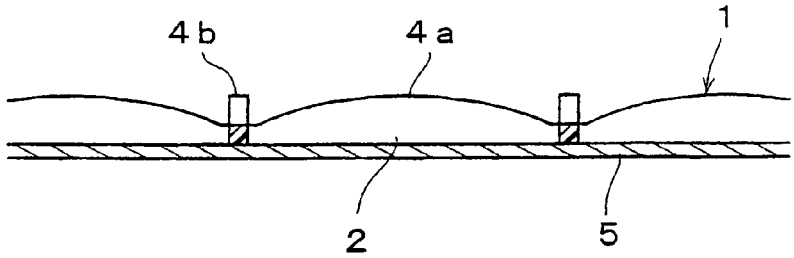
Figure 6A:
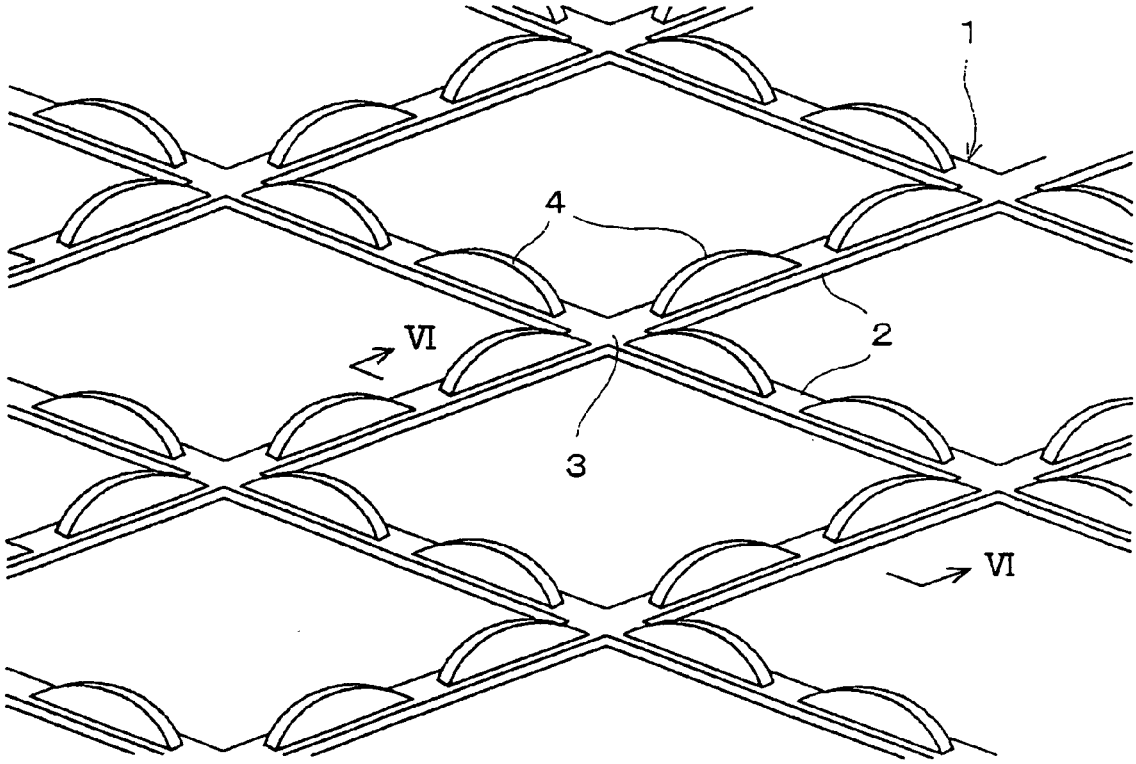
FIG. 6A is an enlarged perspective view showing another modification to the first embodiment and FIG. 6B is a cross sectional view taken along line VI-VI.
Figure 6B:
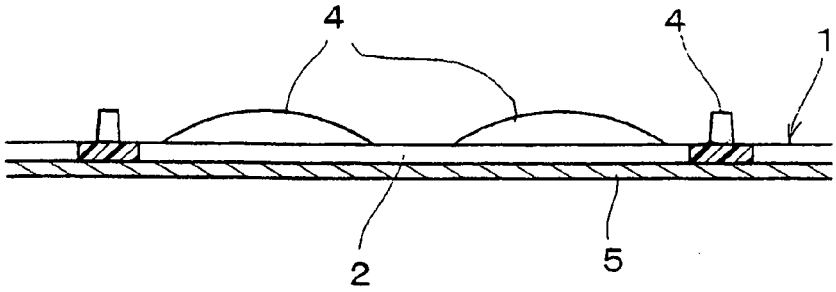

FIGS. 5A and B show a modification example in which stripe-like projections 4*a* that have both ends joined at the knot parts in the manner of the embodiment shown in FIG. 3 are formed on each of the cord parts extending in one direction, e.g., the horizontal direction or the vertical direction, and stripe-like projections 4*b* that span across the knot parts in the manner of the embodiment shown in FIG. 4 are formed at the center thereof on each of the cord parts extending the other direction, which orthogonally intersects the one direction. Furthermore, in the modification example shown in FIGS. 6A and B, arc-shaped stripe-like projections 4 that are shorter than those in the embodiments of FIG. 1 and FIG. 2 are formed at equal intervals such that two are arranged on each cord part.

Figure 7:
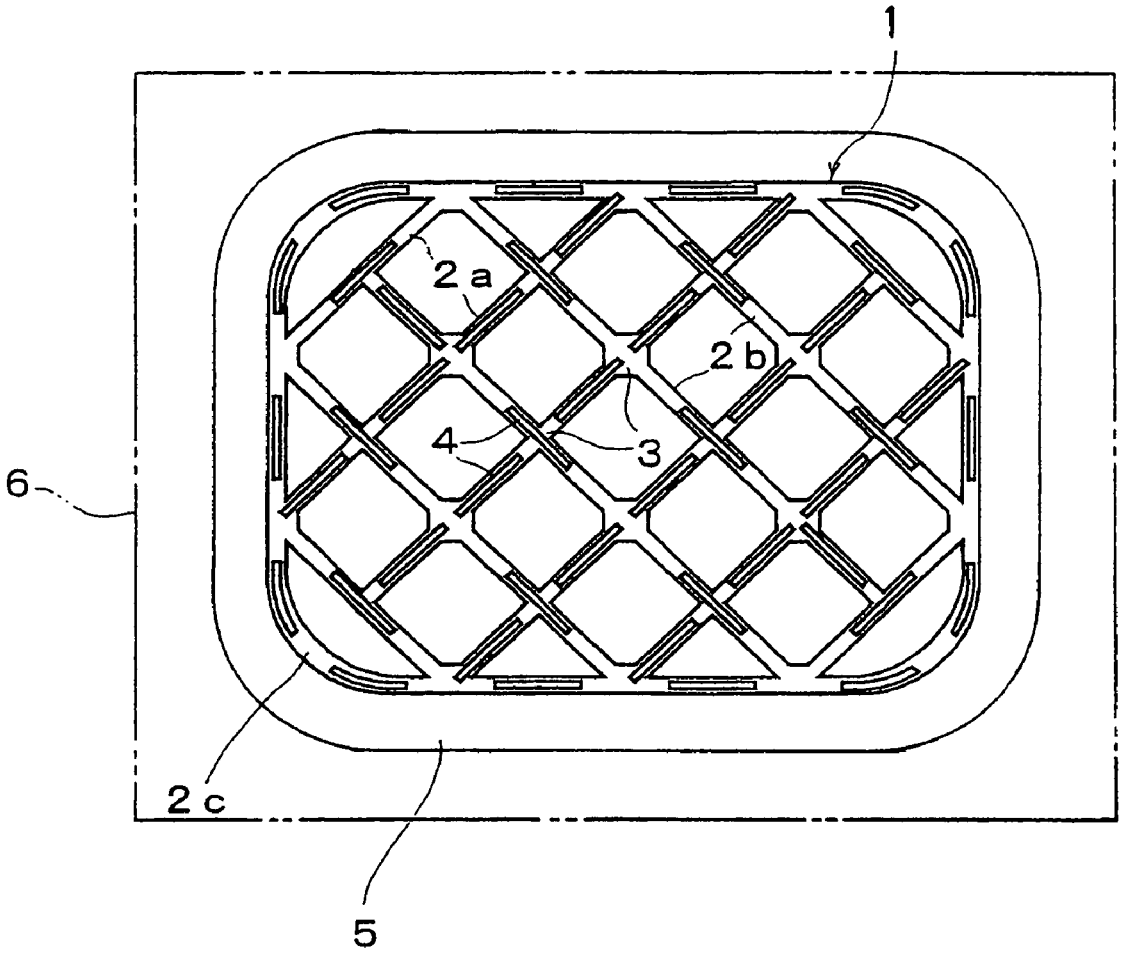
FIG. 7 is a plan view showing a second embodiment of the present invention.
Figure 8:
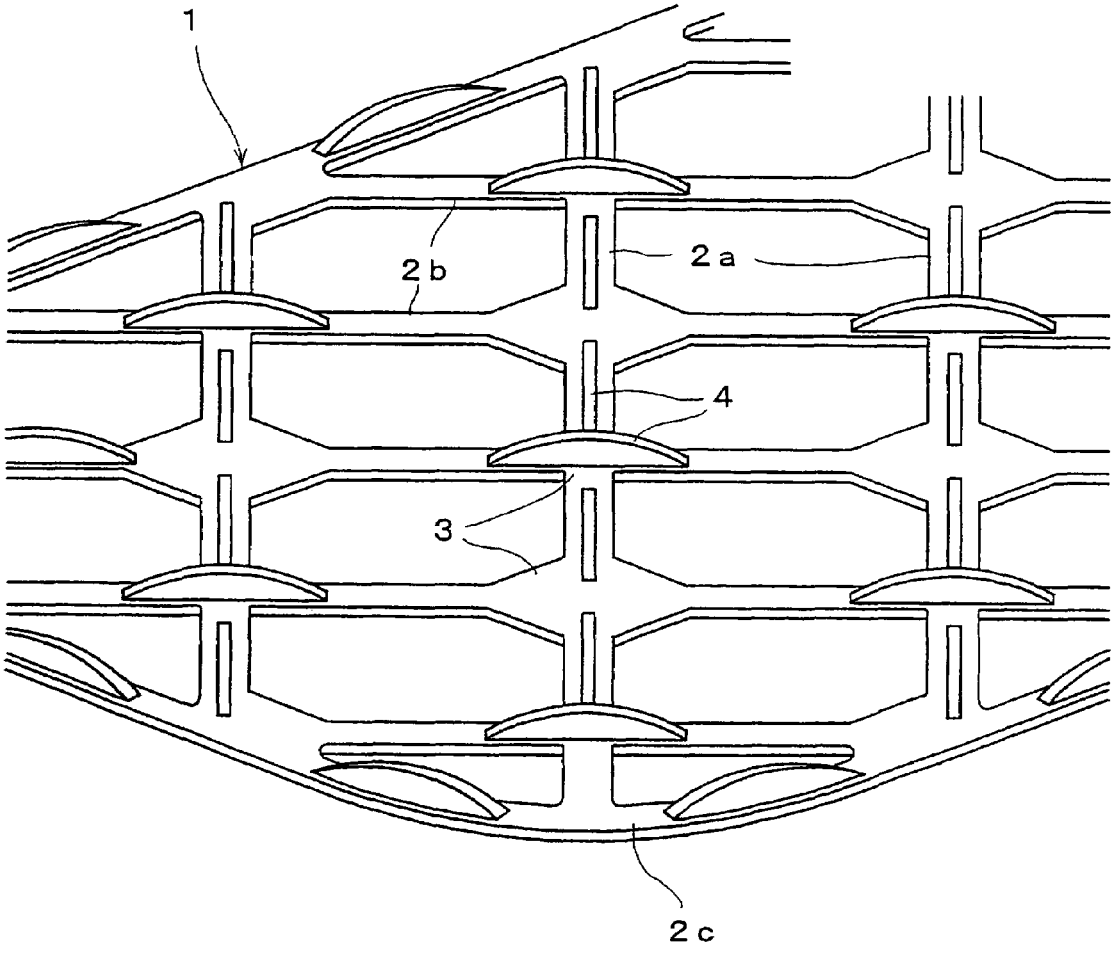
FIG. 8 is an enlarged perspective view of the second embodiment.

FIGS. 7 and 8 show a second embodiment of the present invention. The sheet member 1 of the second embodiment has an outline roughly the shape of a rectangle with rounded corners and, similarly to the first embodiment, is formed in a thin, net-like shape from a synthetic resin material. This sheet member has roughly the same external dimensions as the sheet member of the first embodiment, but each cord part 2*a*, 2*b* is provided slanted at a 45-degree angle with respect to the horizontal and the mesh is finer than in the first embodiment.

As shown also in FIG. 8, on the surface of sheet member 1 are similarly formed many arc-shaped stripe-like projections 4, which are evenly distributed over roughly the entire surface and are integral with said sheet member. The stripe-like projections 4 of this embodiment are arranged at fixed intervals such that they are positioned on the cord parts 2*a* extending in one direction at the center thereof and on the cord parts 2*b* extending the other direction, which orthogonally intersects the one direction, so as to span across knot parts 3 and exist alternately with respect to adjacent cord parts 2*b*. Also, two stripe-like projections 4 are formed on the cord part 2*c* of each round corner part so as to be somewhat curved in alignment with the curvature of the corner part. Therefore, in comparison with the first embodiment, more stimulation can be applied more densely to the treatment part of the skin surface.

Similarly to the first embodiment, the smooth rear surface of sheet member 1 is fastened to the adhesive surface—which is coated completely with a pressure sensitive adhesive—of an adhesive sheet 5 that has somewhat larger dimensions than and roughly the same shape as the sheet member. In order to protect the adhesive surface thereof, adhesive sheet 5 has attached thereto a release paper 6 that has been surface-treated with silicon or the like. Although the sheet member of this embodiment has a somewhat finer mesh than the first embodiment, the adhesive surface of adhesive sheet 5 will peep through the meshes and the stimulator can be more securely fixed to the skin. Also, since the mesh is relatively fine, more gaps are secured between the skin surface and the sheet member than in the first embodiment and warm dampness caused by perspiration and attendant itchiness, rashes, etc., are alleviated.

Figure 9:
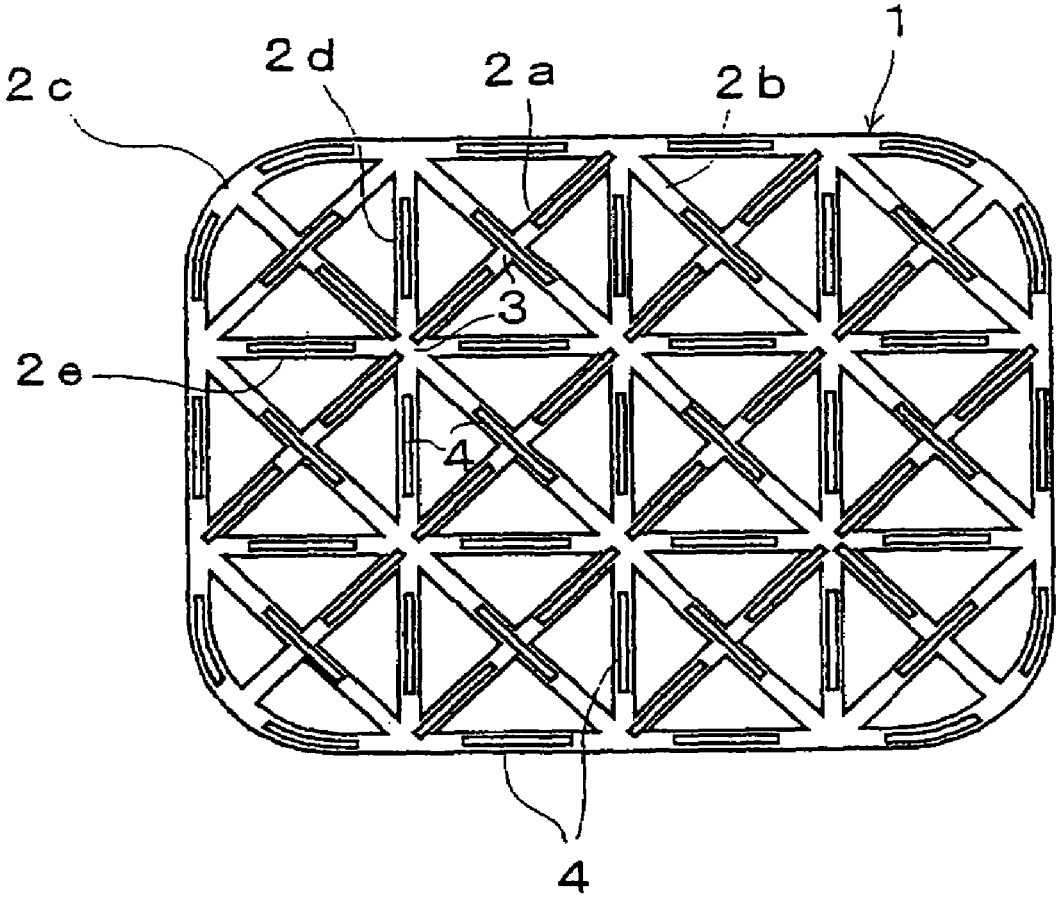
FIG. 9 is a plan view showing a third embodiment of the present invention.
Figure 10:
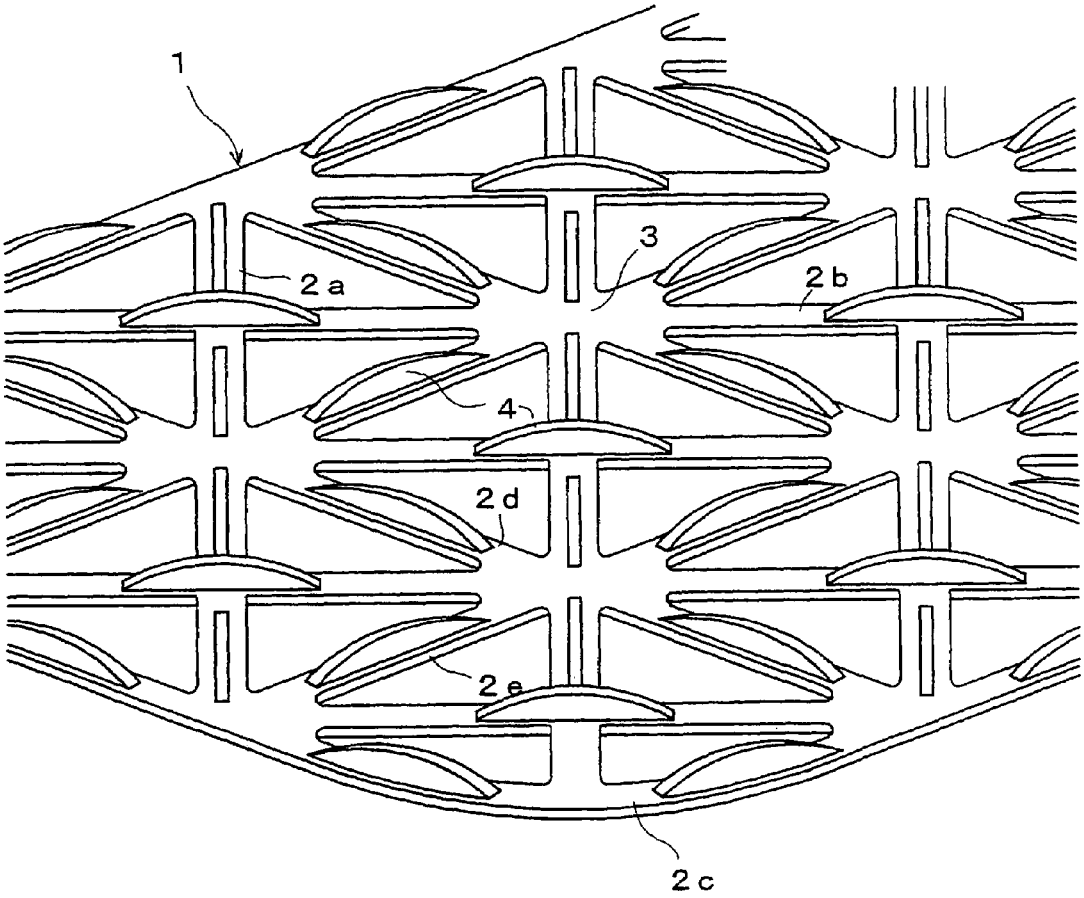
FIG. 10 is an enlarged perspective view of the third embodiment.

FIGS. 9 and 10 show a third embodiment of the present invention. The sheet member 1 of the third embodiment has roughly the same outline as the second embodiment and is formed in a thin, net-like shape from a synthetic resin material. In addition to cord parts 2*a*, 2*b* of the second embodiment, which are slanted with respect to the horizontal, this sheet member is provided with cord parts 2*d*, 2*e* that extend in the horizontal and vertical directions so as to join knot parts 3 with each other and with each corner part, making the mesh even finer than in the sheet member of the second embodiment. In this embodiment, the additional cord parts are provided so as to join only those knot parts that are not provided with a stripe-like projection in the second embodiment, but it is also possible to provide even more additional cord parts so as to join the remaining knot parts in the same manner.

As shown also in FIG. 9, on the surface of sheet member 1 are similarly formed many arc-shaped stripe-like projections 4, which are evenly distributed over roughly the entire surface and are integral with said sheet member. In addition to the arrangement shown in the second embodiment, the stripe-like projections 4 of this embodiment are formed on additional cord parts 2*d*, 2*e* in positions at the centers thereof. Therefore, in comparison with the first and second embodiments, even more evenly distributed stimulation can be applied so as to concentrate on the desired parts of the skin surface.

The finger-pressure substitutive stimulator of the present invention differs from the first and second embodiments in that the an adhesive sheet is not fastened to the rear surface of sheet member 1; instead, the supporter can be fixed to the treatment part of the skin surface using an appropriate separate fixing means, e.g., commercially available adhesive tapes, bandages, and supporters. In particular, when a fixing means that does not use an adhesive—such as a bandage or a supported—is employed, the air permeability is ensured by the meshes of the sheet member and there is no risk of itchiness, rashes, or other inflammation occurring due to an adhesive or due to warm dampness caused by perspiration.

Figure 11:
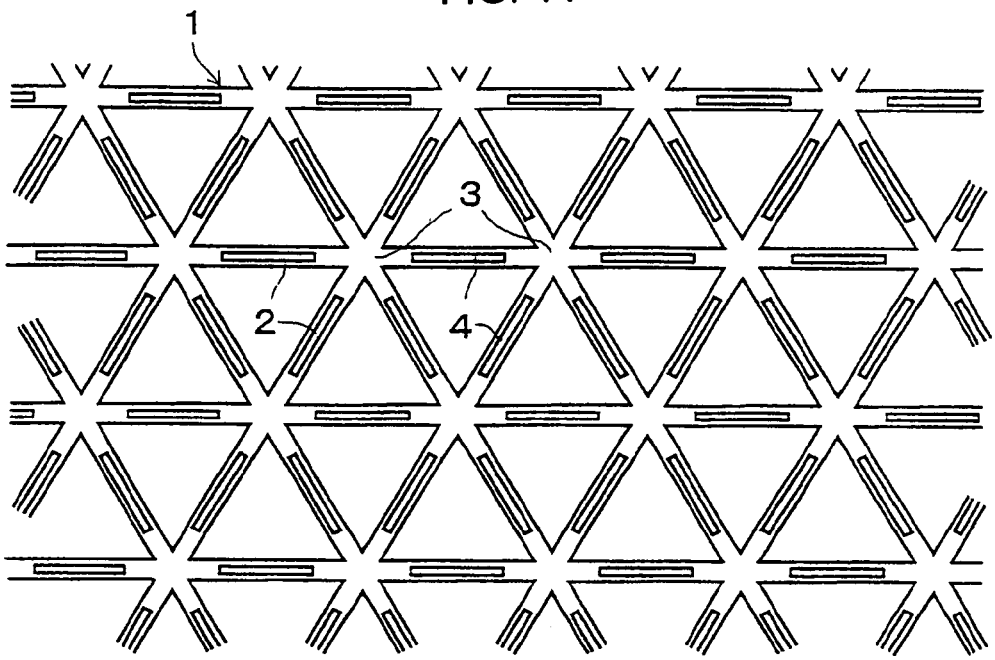
FIG. 11 is a plan view showing a fourth embodiment of the present invention.
Figure 12:
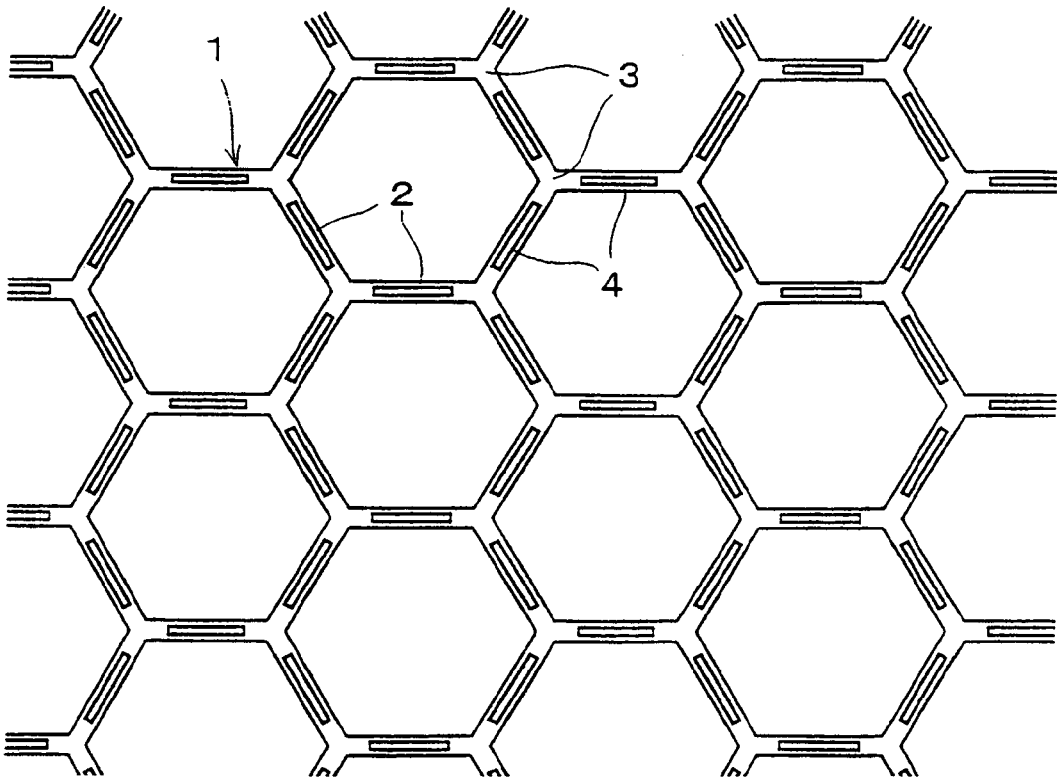
FIG. 12 is a plan view showing a fifth embodiment of the same.

FIGS. 11 and 12 show fourth and fifth embodiments of the present invention, respectively, each of which incorporates a modification of the mesh shape of the sheet member. In the embodiment of FIG. 11, the sheet member 1 is formed so that the meshes are equilateral triangles and a stripe-like projection 4 is arranged at roughly the center of each of cord parts 2, which constitute the sides of the triangles. With this kind of mesh structure, more projections can be arranged more uniformly than in the case of the first embodiment, which has square meshes. Also, since six cord parts 2 join with one knot part 3, the strength of the knot parts with respect to the kind of deformation that occurs when the stimulator is made to curve along a curved part of the skin.

In the embodiment of FIG. 12, the sheet member 1 is formed so that the meshes are equilateral hexagons and a stripe-like projection 4 is arranged at roughly the center of each of cord parts 2, which constitute the sides of the hexagons. The equilateral hexagonal mesh structure is easily deformed by planar forces, thus making it easy for the stimulator to curve along a curved part of the skin.

In the embodiments of both FIG. 11 and FIG. 12, the stripe-like projections 4 are arranged at the center of cord parts 2, but the projections can also be provided so as to span across knot parts 3 as in FIG. 4 and FIG. 7. If this is done in the embodiment of FIG. 12, Y-shaped stripe-like projections will be formed that extend radially from centers at knot parts 3. Also, regarding the embodiments of FIG. 11 and FIG. 12, depending on the size of the meshes, an adhesive sheet can be fastened to the rear surface of the sheet member in the manner of the first and second embodiments or the stimulator can be fixed to the skin using a separate fixing means, such as a bandage or a supporter, as in the third embodiment.

Here ends the detailed description of the preferred embodiments of the present invention. As should be clear to those skilled in art, the present invention can be worked within its technical scope by adding various modifications and changes to the previously described embodiments. For example, the shape and dimensions of the meshes of the sheet member and the shape, dimensions, and arrangement of the stripe-like projections can be selected in various ways depending on the part of the human body where the stimulator will be used, the width of the range of that part, the symptoms, the severity of the symptoms, etc.

The invention claimed is:

1. A finger-pressure substitutive stimulator, comprising:

a sheet member formed of a hard or semi-hard synthetic resin material, as a mesh with a net-like structure sufficiently thin that when pressed against the skin of a human body conforms to a curved shape of the skin and changes occurring in the shape, and having many projections molded integrally therewith, the projections formed on, elongated along, and projecting from one surface thereof, wherein said sheet member has a thickness of about 0.3 mm, and said projections have a slender, straight stripe-shape of length about 5 mm, height about 1 mm and width about 0.3 mm, and with a gentle arc in side view and an upwardly slightly tapered cross section.

2. A finger-pressure substitutive stimulator, comprising:

a sheet member, wherein said sheet member is formed of a hard or semi-hard synthetic resin material with meshes so as to define a net-like structure, and sufficiently thin that when pressed against the skin of a human body exhibits sufficient suppleness to conform to a curved shape of the skin of the human body and changes in said curved shape, wherein said sheet member has many projections, stripe-shaped in plan view, formed evenly on one surface thereof and molded integrally therewith, and wherein said sheet member has a thickness of about 0.3 mm, and said projections have a slender, straight stripe-shape of length about 5 mm, height about 1 mm and width about 0.3 mm, and with a gentle arc in side view and an upwardly slightly tapered cross section.

3. A finger-pressure substitutive stimulator, comprising:

a sheet member formed of a hard or semi-hard synthetic resin material, as a mesh with a net-like structure sufficiently thin that when pressed against the skin of a human body conforms to a curved shape of the skin and changes occurring in the shape, and having many projections molded integrally therewith, the projections formed on, elongated along, and projecting from one surface thereof, wherein said sheet member has another surface opposite the one surface, wherein said finger-pressure substitutive stimulator further comprises an adhesive sheet having a bonding surface coated with an adhesive, fastened to another surface of said sheet member, so that said adhesive sheet can stick to a surface of the skin through the mesh of said sheet member, and wherein said sheet member has a thickness of about 0.3 mm, and said projections have a slender, straight stripe-shape of length about 5 mm, height about 1 mm and width about 0.3 mm, and with a gentle arc in side view and an upwardly slightly tapered cross section.

4. A finger-pressure substitutive stimulator, comprising:

a sheet member, wherein said sheet member is formed of a hard or semi-hard synthetic resin material with meshes so as to define a net-like structure, and sufficiently thin that when pressed against the skin of a human body exhibits sufficient suppleness to conform to a curved shape of the skin of the human body and changes in said curved shape, wherein said sheet member has many projections, stripe-shaped in plan view, formed evenly on one surface thereof and molded integrally therewith, wherein said sheet member has another surface opposite the, one surface, wherein said finger-pressure substitutive stimulator further comprises an adhesive sheet having a bonding surface coated with an adhesive, fastened to another surface of said sheet member, so that said adhesive sheet can stick to a surface of the skin through the mesh of said sheet member, and wherein said sheet member has a thickness of about 0.3 mm, and said projections have a slender, straight stripe-shape of length about 5 mm, height about 1 mm and width about 0.3 mm, and with a gentle arc in side view and an upwardly slightly tapered cross section.

* * * * *